US006763873B2

(12) United States Patent
Lee

(10) Patent No.: US 6,763,873 B2
(45) **Date of Patent: *Jul. 20, 2004**

(54) EFFICIENT, NATURAL SLAT SYSTEM, COVERING AND METHOD

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 29 days.

This patent is subject to a terminal disclaimer.

(21) Appl. No.: 10/120,468

(22) Filed: Apr. 10, 2002

(65) Prior Publication Data

US 2002/0108723 A1 Aug. 15, 2002

Related U.S. Application Data

(63) Continuation-in-part of application No. 09/846,488, filed on Apr. 30, 2001, which is a continuation-in-part of application No. 09/781,511, filed on Feb. 9, 2001, now Pat. No. 6,450, 235.

(51) Int. Cl.[7] ..... E06B 3/12
(52) U.S. Cl. ..... 160/236
(58) Field of Search ..... 160/236, 232, 160/235, 173 R, 168.1 R, 176.1 R, 405

(56) References Cited

U.S. PATENT DOCUMENTS

| | | | |
|---|---|---|---|
| 528,741 | A | 11/1894 | Rastetter |
| 757,812 | A | 4/1904 | Keyes |
| 1,639,474 | A | 8/1927 | Whitmore |
| 2,275,975 | A | 3/1942 | McClone |
| 2,830,834 | A | 4/1958 | Wildhaber |
| 2,926,729 | A | 3/1960 | Zanini |
| 3,204,300 | A | 9/1965 | Hofmann |
| 3,262,723 | A | 7/1966 | Strickler |
| 3,355,196 | A | 11/1967 | Harrison |
| 3,480,054 | A | 11/1969 | Marian |
| 3,645,317 | A | 2/1972 | Malone |
| 3,692,340 | A | 9/1972 | Roth |
| 4,053,339 | A | 10/1977 | Story et al. |
| 4,333,509 | A | 6/1982 | Conn |
| 4,336,834 | A | 6/1982 | Schaller |
| 4,353,404 | A | 10/1982 | Trantow |
| 4,435,104 | A | 3/1984 | Held |
| 4,884,615 | A | 12/1989 | Hsu |
| 5,121,785 | A | 6/1992 | Ohsumi |
| 5,750,234 | A | 5/1998 | Johnson et al. |
| 5,755,068 | A | 5/1998 | Ormiston |
| 5,846,646 | A | 12/1998 | Meppelink |
| 5,919,537 | A | 7/1999 | Niazy |
| 5,967,207 | A | 10/1999 | Chen |
| 5,985,415 | A | 11/1999 | Giltner |
| 5,996,672 | A | 12/1999 | Kotin |
| 6,120,886 | A | 9/2000 | Grafe et al. |
| 6,192,964 | B1 | 2/2001 | Cianci et al. |
| 6,450,235 | B1 * | 9/2002 | Lee ..... 160/236 |

* cited by examiner

*Primary Examiner*—David Purol
(74) *Attorney, Agent, or Firm*—Curtis L. Harrington

(57) ABSTRACT

The structures and process for producing the structures of the invention enable extensive and efficient use of block scrap for slat manufacturing. The techniques employed advantageously accomplish two goals simultaneously, enabling scrap, such as block scrap, to be formed into longer effective lengths. Such longer effective lengths can then be cutably formed into slats of various sizes. The joinder of the block scrap is by deeply extending, finite interlock length finger joints which, once the material is cutably formed into slats, remain as relatively shallow and finite interlock length finger joints. The joints have the added benefit that they statistically "break up" any grain differences which would otherwise create warp, and enable long lengths of slat to be employed from several shorter lengths of scrap. An applied covering layer may be applied by wrapping or insertion. An ultraviolet resistant lacquer may be applied to the covering layer for long window life and attractive finish.

20 Claims, 7 Drawing Sheets

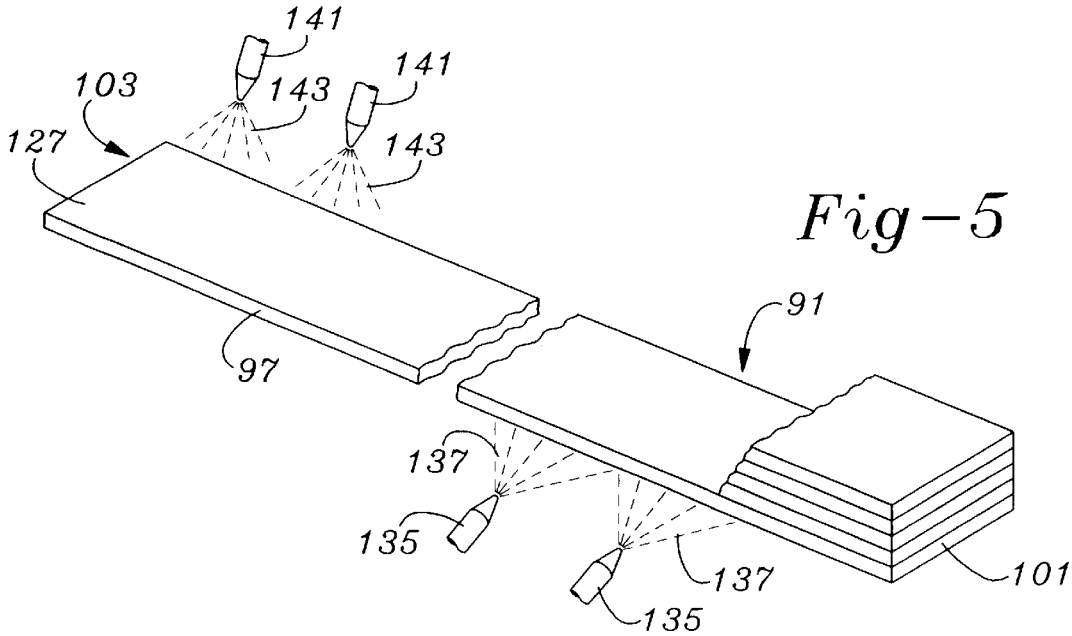
Fig-5
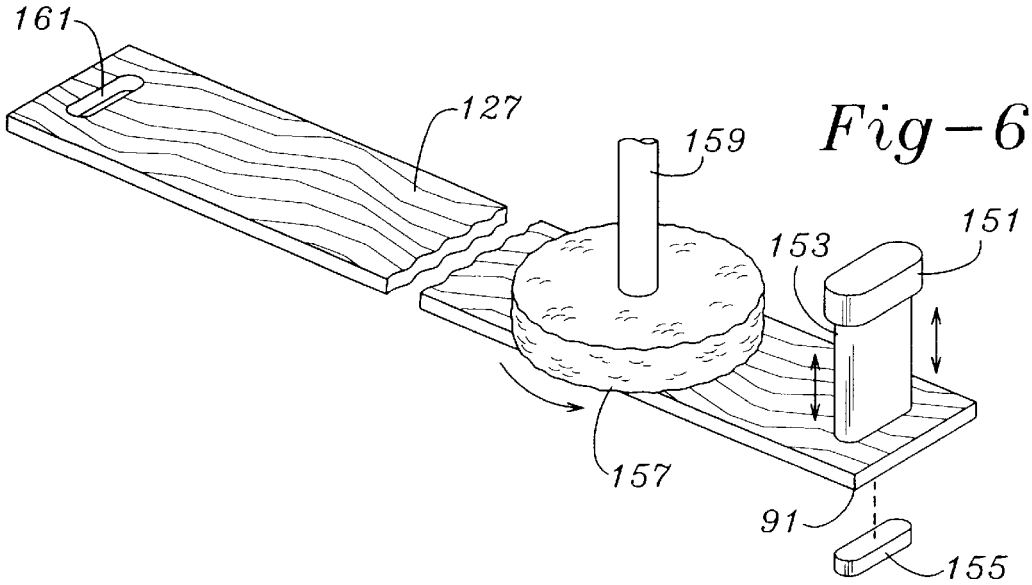
Fig-6
Fig-7
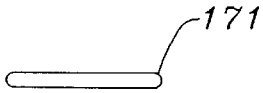
Fig-8
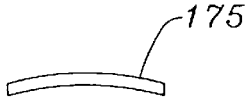
Fig-9
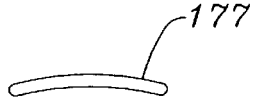

EFFICIENT, NATURAL SLAT SYSTEM, COVERING AND METHOD

This application is a continuation-in-part of U.S. patent application Ser. No. 09/846,488 FILED Apr. 30, 2001, which is a continuation-in-part of U.S. patent application Ser. No. 09/781,511 filed Feb. 9, 2001 now U.S. Pat. No. 6,450,235.

FIELD OF THE INVENTION

The present invention relates to a slat and method for constructing slats which is efficient, warp resistant, saving of natural resources, and longer slat of natural materials without warping, to enable the construction of a high quality, consistent louver product of any practical dimension.

BACKGROUND OF THE INVENTION

Slats are utilized in a variety of window coverings, including Venetian blinds, and vertical blinds. Slats have in the past been constructed of thin metal from rolls, curved along the path of their shorter dimension to produce a break through stiffness, holding stiff unless stressed. More recent slats include relatively thicker structures whose stiffness is similar to that of a ruler. Modern materials have enabled the construction of slats having a wide variety of strength and size, and other attributes associated with the materials from which they were constructed.

Slats constructed of such synthetic material have a main disadvantage of cost, both through raw material scarcity and processing time. Carbon based materials can require pressure based formation as well as consideration relating to sizing shrinkage and other dimensional accommodation.

Natural materials, especially wood, are uneven and tend to warp. Warping in long slats is especially pronounced during periods of humidity change. Formation in one humidity environment followed by installation in a different humidity environment will typically result in twisting, bending, and general un-evenness. Further, the effects may occur at different locations along the length of the slats, and such effects cannot typically be defensed against by treating or sealing, as most materials are permeable to moisture. Selection of lengths of wood of even grain creates an even more severe materials problem as the reject rate for material rises and the costs rise further.

Furthermore, in the construction of wood slats, there occurs a consistent level of waste based upon statistical differences between the lengths of raw material and the lengths and processing requirements for the individual slat sizes. This waste is extremely significant and contributes to the overall cost for natural slats. Where waste material has a longitudinal (with the grain, for example) size which is less than the minimum length slat, it is disposed of as scrap or refuse. Such scrap is significant in the slat production process and not only drives up cost, but results in a wasting of natural resources by causing more natural resources than are absolutely needed for the slats as being spent.

Utilization of absolute small sized scrap has been had by further costly processing as by making of press board and composites which are dependent upon costly processing, and do not lend themselves to use with slats since the bending strength must extend over a long length, much like a ruler or yardstick. There is a further waste in such scrap as utilization in press board requires further cutting and chipping and further destroys the structural integrity of the material structure present. Beyond press board, the only other value of such small scrap is the thermal value on burning.

A final problem is the extent to which wood scrap can be used to form slats which have a finished wood appearance. Where users want slats which have a natural wood appearance, as if the slat were cut from a continuous length of grained wood, the resources otherwise utilized would be even higher. What is needed is a method which enables wood scrap to be utilized to form a slat which has more of a natural wood appearance to avoid the even more inefficient practice of providing a slat from a whole length of starting wood material.

SUMMARY OF THE INVENTION

The structures and process for producing the structures of the invention enable extensive and efficient use of block scrap for slat manufacturing. The techniques employed advantageously accomplish two goals simultaneously. The technique enables scrap, such as block scrap, to be formed into longer effective lengths. Such longer effective lengths can then be cutably formed into slats of various sizes. The joinder of the block scrap is by deeply extending, finite interlock length finger joints which, once the material is cutably formed into slats, remain as relatively shallow (the thickness of the slat) and finite interlock length finger joints. The joints have the added benefit that they statistically "break up" any grain differences which would otherwise create warp, and enable long lengths of slat to be employed from several shorter lengths of scrap. The utilization of multiple sets of finger joints virtually completely eliminates the tendency to warp, and provides additional strength against twist forces. Further, as an added economic benefit above and beyond the benefits already mentioned, the technique not only enables waste normally occurring in slat manufacture to be saved, but actually encourages the manufacture of a superior quality product by encouraging lower cost scrap to be used as the primary resource in the manufacturing process. In other words, longer lengths of higher priced wood can be used elsewhere in products where grain structure and uninterrupted length is necessary, and thus drive down the costs in those industries, while at the same time enabling slat construction almost exclusively from scrap.

To further utilize scrap wood and to further reduce waste, adjacent narrower widths of wood can be utilized in combination with wider lengths of wood at the finger joint to enable two or more widths of wood material to function as if they were a single width of material. When securely glued, both at the finger joint as well as along the lengths of more narrow material, the resulting slats have as much strength as slats formed from a whole length of wood material. Even where the narrow lengths of wood have a linear, thin, glued interface, superior strength bending and twist resistance is observed.

A technique for covering the constructed slat with a layer of paper, especially paper bearing a wood grained pattern, followed by use of a gluing material of, for example vinyl acetate resin, followed by providing a clear and appropriately surface finish varnish, preferably of ultraviolet resistant material can produce a slat which has an appearance exactly as if it were formed from a single length of wood material.

BRIEF DESCRIPTION OF THE DRAWINGS

The invention, its configuration, construction, and operation will be best further described in the following detailed description, taken in conjunction with the accompanying drawings in which:

FIG. 5 is a perspective view of the slat seen in FIG. 4 and split into two zones illustrating the application of a glaze layer in one zone and showing the application of a side surface paint layer, either singly or with a stack of such slats;

FIG. 6 is a perspective view of the slat seen in FIG. 5 and split into two zones illustrating the application of a buffing or touch finish and a punching operation in one zone, and illustrating a finished appearance, including an aperture, in the other zone;

FIG. 7 is an end view of an oval shaped slat;

FIG. 8 is an end view of a slat having double curvature;

FIG. 9 is an end view of a slat having uneven curvature and rounded edges;

FIG. 10 illustrates a perspective view of three boards being joined together as by gluing and the like;

DETAILED DESCRIPTION OF THE PREFERRED EMBODIMENT

Figure 1:
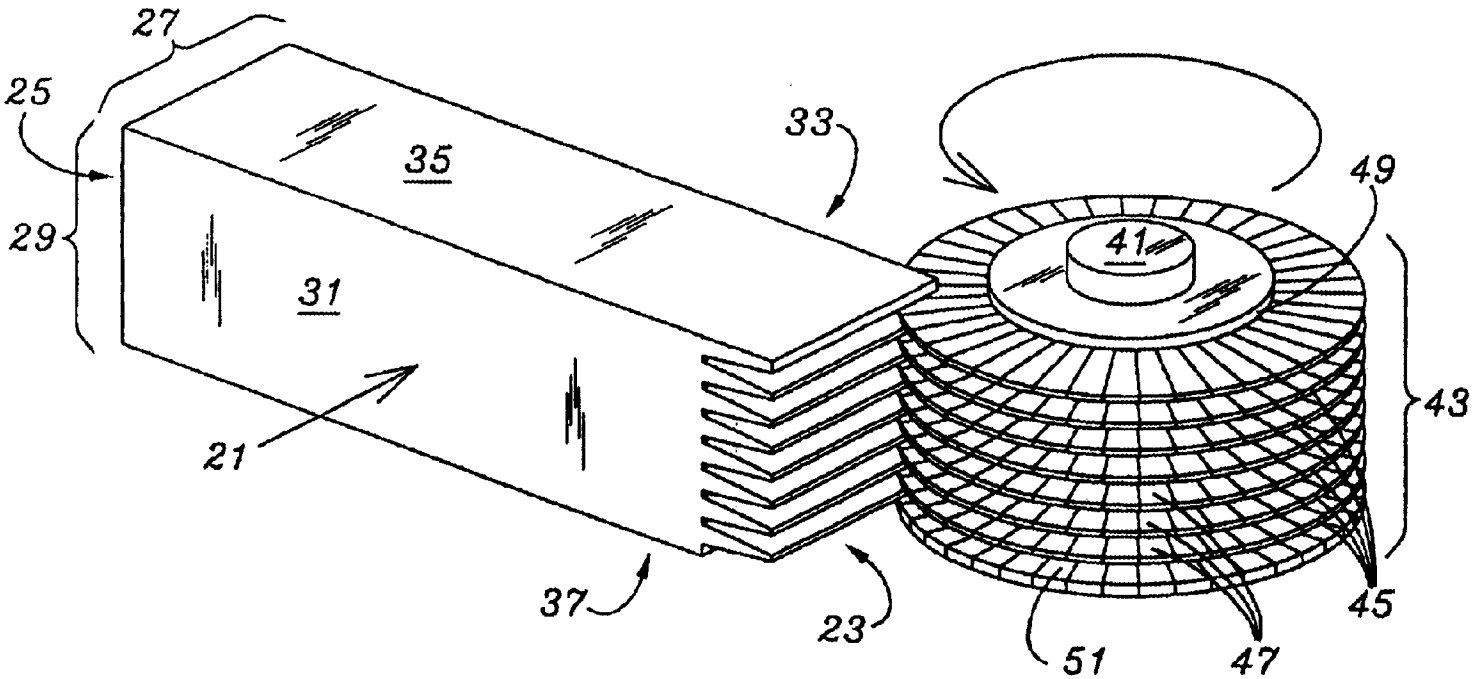
FIG. 1 illustrates a perspective view of a short length of board rectangular board facing round saw having a particular shape, at a point of moving past a saw blade having a shape to form a locking shape at the end of the board.

The description and operation of the shutter system of the invention will begun to be best described with reference to FIG. 1 which illustrates a perspective view of a short length of generally rectangular board 21. Explanation of the orientation of the formed shapes and subsequent slat producing cutting operations will need to take account of the orientation of matching shapes in the wood, as well as cutting orientation.

As such, the board 21 is seen to have a first end 23 and a second end 25. The board 21 has a height 27 and a width 29. Height 27 extends between a first surface 31 and an oppositely disposed second surface 33. Width 29 extends between a third surface 35 and an oppositely disposed second surface 37. The first end 23 will be shown to be processed, but the second end 25 can also be processed such that a series of such relatively short boards 21 can have ends formed for matching together.

A rotating saw head 41 is seen as having an overall saw shape 43 as an overall bellows shape having, when viewed from the side, a series of alternating triangular radial extensions or protrusions 45 separated by a series of alternating triangular radial depressions 47. The ideal depth of each triangular protrusion from tip to base (such base forming the tip of the space between each triangular projection) is approximately ten to fifteen, and preferably eleven to thirteen millimeters in depth. The width of the triangular projection at its base (and so the tip separation of the triangular extensions at their tips is from about two to six millimeters and preferably about four millimeters apart. This triangular "finger" shape, then, has an ideal ratio of height to width of about twelve or thirteen to four, or about 2.75:1 to about 3.25:1. This ratio and the absolute dimensions may change for different sized slats, especially to form the requisite contact area, but the above ratios and surface extents have been found to work well.

The overall length of slat producible utilizing the steps and structures shown can include slat lengths of even longer than ten feet. Slat widths can vary from as narrow as several millimeters to more than 10 centimeters. The same force withstanding limitations in a natural slat made from a single length of material is applicable to the slat made from multiple boards. Thus, the multiple board technique herein can be used to make any slat which would otherwise be made from a continuous length of natural or man made materials.

Note that the pattern of protrusions 45 separated by a series of alternating triangular radial depressions 47 ends at one end of the rotating head 41, with a relatively larger width depression 49 at one end and a relatively larger width protrusion 51 at the other end. The pattern of protrusions 45 and depressions 47, if they terminated at the center of either, would leave a resulting end protrusion on the board 21 having a half width tip which would be subject to bending, breaking and shattering, either by unintended touching during processing or even by further surfacing operation on the board 21 even where two ends 27 of boards 21 are joined and affixed to each other. In other words, it would leave simply too sharp of an edge and which may result from further destruction in further processing, or in breaking off, result in a gap or depression in the wood. The overall saw shape 43 is meant to give a shape which enables the fitting of first ends 23 which are complementary to each other, rather than a mirror image of each other.

Figure 2:
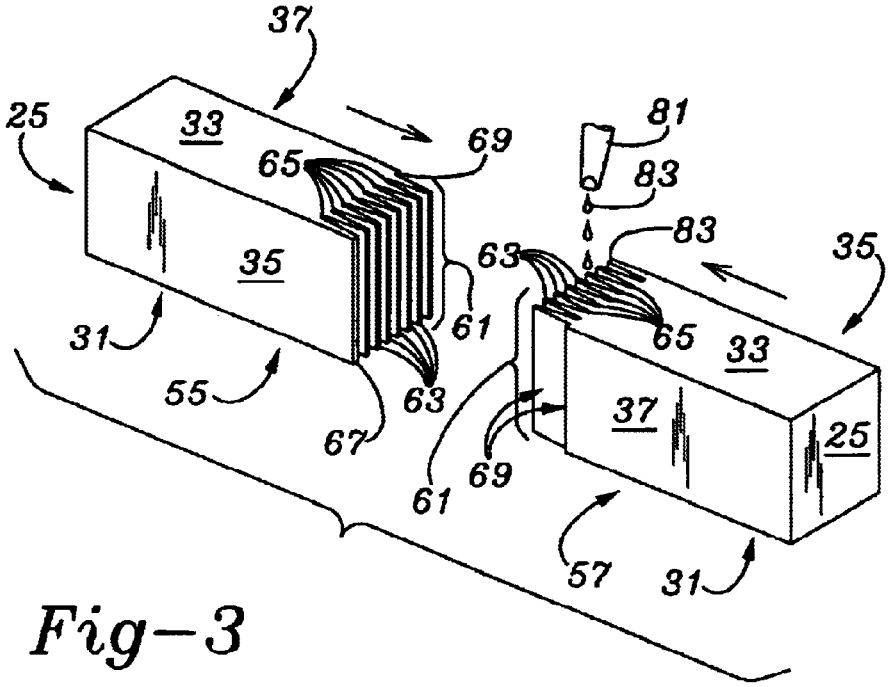
FIG. 2 is a perspective view of two short lengths of board turned so that the locking shapes oppose each other, one board being rotated so that the interlocking shapes will be complementary for a fully engaged fit.

Referring to FIG. 2, a perspective of two short lengths of board 21, including a board 55 and a board 57, this designation used only to tell them apart, with the resulting board end shapes 61 at their respective first ends 23 are seen adjacent each other. Resulting board end shapes 61, taking board 57 as an example, each include a linear series of wood protrusions 63, alternating between a linear series of wood depressions 65 which each extend between first surfaces 31 and second surfaces 33 of board 57. Board 55 has complementary set of protrusions 63, also alternating between the linear series of wood depressions 65. The board 57, for example has a relatively thicker end protrusion 67, corresponding to formation by relatively larger width depression 49, adjacent surface 35. The board 57 also has a relatively thicker width depression 69, corresponding to formation by relatively larger width protrusion 51, adjacent surface 37.

Note also that board 55, for example, has a relatively thicker end protrusion 67, corresponding to formation by relatively larger width depression 49, adjacent its surface 35, and a relatively thicker width depression 69, corresponding to formation by relatively larger width protrusion 51, adjacent surface 37. However, note the positioning of board 55, in that it is rotated 180 degrees about its central axis and is seen such that surface 35 of board 55 is most closely adjacent surface 37 of board 57. This 180 degree rotation of one board, say board 55, with respect to the other board 57 is so that the surfaces 61 are now fully complementary and may be brought together to a snug fit, with significant surface area.

Where the height and width of the boards are one square unit, and where the contribution of the relatively thicker protrusion 67/depression 69 are ignored, each regular protrusion of 4 millimeter base, 2 millimeter half base and a 12.5 millimeter height, by trigonometry produces a linear extent of two times the square root of the sum of the latter two amounts squared, or about 25.31 additional linear extent for each base width. For a base of 4 millimeters, a 10 millimeter wide length has a linear contact length of about 63.3 millimeters. This is a contact surface area of 6.33:1.0, since the contact in the other direction is directly proportional to the height, or distance in the direction parallel to the general extent of the protrusions 63 and depression 67. Thus, this amount of increased contact, and this geometry of interlocking connection has been found to equal or exceed the strength needed to form a relatively longer slat from relatively shorter pieces.

In the process as set forth, it will be shown that the blocks 55 and 57 may be joined at a time when they are have a distance between surfaces 31 and 33 of sufficient dimension to form several slats, especially where each operation forming board end shapes 61 may follow more efficiently. Further, to maintain the finger orientation, the generalized plane of the board shapes 61 is perpendicular to the plane of the slats which will be formed from the boards 55 and 57, and also, more specifically, the plane formed in a direction along the lengths of the linear series of wood protrusions 63, and linear series of wood depressions 65 will also be perpendicular to the plane of the resulting slats.

Taken from the perspective of board 57, for example, the slats will be formed having surfaces parallel with surfaces 31 and 33. Any slat whose major surfaces were parallel to the surfaces 35 and 37, or to the extent of the linear series of wood protrusions 63, and linear series of wood depressions 65 would be weak because (1) there would be joinder force only in proportion to the slat thickness which is not desired, and (2) would have a bending force applied tending to directly separate any surfaces of the board end shapes 61 rather than taking advantage of the finger geometry, where major bending forces would tend to move the fingers laterally among each other rather than to promote an angled separation.

The view of FIG. 2 is looking in perspective into the board end shapes 61 which will be angularly displaced as they are brought together to bring the opposing end shapes 61 into interlocking contact with each other. A glue applicator 81 is seen in schematic over the boards 55 and 57 as administering droplets of glue 83 as may be appropriate to join the first ends 23 of the boards 55 and 57. Glue 83 may be applied in any manner, including spraying or by providing an amount to be squeezed out when the ends 23 of the boards 55 and 57 are brought together. Further techniques may involve the use of hot glue, solvent glue, setting glue, and the like. Further, pressure may be placed on the boards 55 and 57 against each other during and after the glue 83 application process in order to accelerate the surface process and enhance the holding strength and interfit of the boards 55 and 57. Once the glue is dried or set, the joined boards 55 and 57 may have their second ends 25 processed with the rotating saw head 51 as shown in FIGS. 1 and 2, for adding further lengths together. In some cases, this may be repeated several times to accomplish two goals simultaneously. A given length of formed slat can then utilize much smaller amounts of scrap, and a given length of formed slat will have the effect of the natural differences in wood grain, the tendency of its lengths to warp, to be further truncated, and linearity matched.

Figure 3:
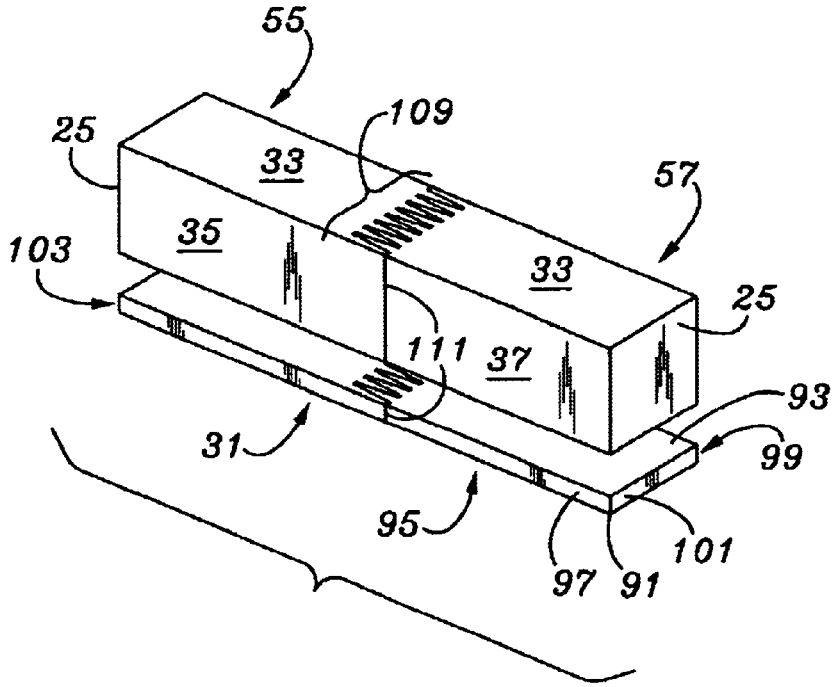
FIG. 3 is a perspective view looking down upon the boards of FIG. 2 as fused together to form a joined board and orientated so that a finger pattern is directed upwardly, and illustrating a slat being cutably removed from the bottom.

Referring to FIG. 3, a perspective view looking down upon the interlocking boards 55 and 57 seen in FIG. 2, and especially the top portion, shows the effective formation of a new board in terms of its overall shape. Upon first formation of the structure, especially the upper structure seen in FIG. 2, it may be advantageous to sand the major surfaces, such as surfaces 33, 31, and the planar interfaces between surfaces 35–37 on either of their two sides. Sanding while the structure of FIG. 3 is in a block shape may be more convenient in eliminating any mismatch, on any side, especially at the interface. Further, where boards 55 and 57 would be sanded in any event, sanding of the completed structure of FIG. 3 may facilitate handling and eliminate further sanding where desired, such as side edges of formed slats, etc.

A section of the interlocking boards 55 and 57 of FIG. 3 have been segregated as a slat 91. For orientational purposes, the slat 91 has a first surface 93 and a second surface 95 which is oppositely disposed with respect to surface 93 and indicated by a curved under arrow. As seen in FIG. 3, surface 93 is a cut surface, formed by cutting away from boards 55 and 57. This surface may be sanded smooth, but it is not necessary to produce the type of surface purity where surface 93 is to be later covered with a material which would overlay, hide, cover or redistribute glue or filler which would otherwise be used to affix such covering material.

Surfaces 93 and 95 are the largest surfaces of the slat 91 and are typically the upper and lower surfaces, the slat 93 being considered as a flat structure. Slat 91 has a first side surface 97 and a second side surface 99 not immediately viewable from the perspective of FIG. 3 and shown with a hook arrow indicating the surface opposite to first side surface 97. Slat 91 has a first end surface 101 and a second end surface 103 not immediately viewable from the perspective of FIG. 3 and shown with a hook arrow indicating the surface opposite to first end surface 101.

The direction in which each of the slats 91 is cut forms a reproduction of the zig-zag pattern seen between surfaces 33 at the top of the boards 55 and 57 of FIG. 3. The "fingers" formed by the linear series of wood protrusions 63 and linear series of wood depressions 65 extend across the width of the slat 91, between side surfaces 97 and 99, as they cross the surfaces 93 and 95. The linear lengths of the outermost protruding edges linear series of wood protrusions 63 extend internally, within the slat 91, between the first surface 93 and second surface 95. The linear extent of the linear series of wood protrusions 63 will thus always be perpendicular to the main extent of the upper and lower surfaces 93 and 95. The finger pattern seen on the top of the slat 91, and indeed between the surfaces 33 of boards 55 and 57 is hereinafter referred to as finger pattern 109.

A side separation line 111 is seen between the joined tip end of the relatively thicker end protrusion 67 and relatively thicker width depression 69, and carries on into the slat 91 after it is separated by cutting from the two joined boards 55 and 57.

Figure 4:
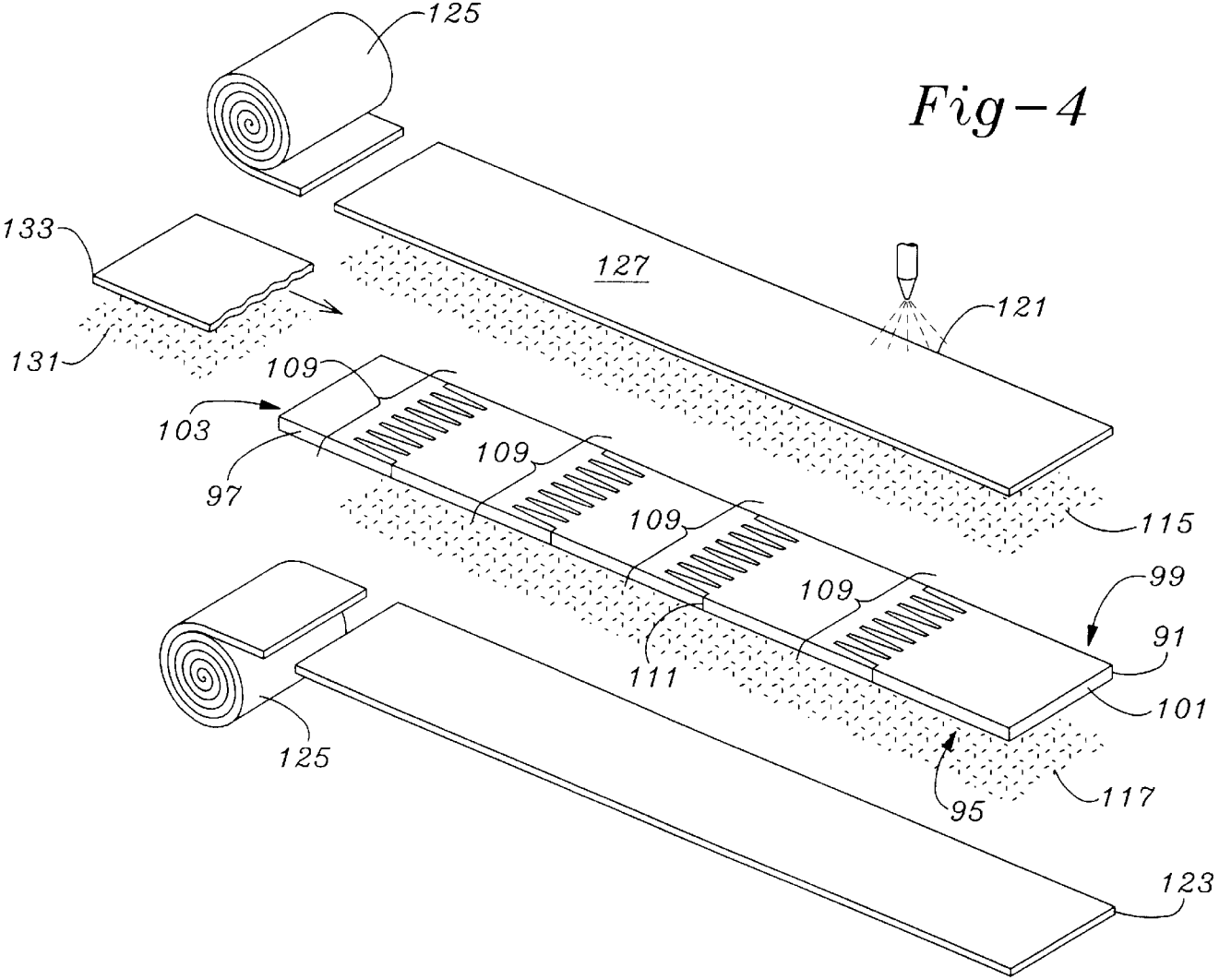
FIG. 4 is a perspective view of a slat seen in FIG. 3 undergoing attachment of a decorative layer on its major upper and lower sides, such as paint or paper or other material, possibly utilizing an application of a glue layer, and optional glue and cover layer where the wood is discolored.

Referring to FIG. 4, an exploded perspective view illustrates further processing as applied to the slat 91. The slat 91 shown has four finger patterns 109 merely to illustrate that many are possible. In general, the slat 91, made up of wood from both joined boards 55 and 57, and indeed may be made from other joined boards, the merely two joined boards 55 and 57 being the simplest example. Ideally the wood grain and color will be compatible, but it may not be compatible. In many cases, in the natural state of slat 91 as it appears just after cutting, the finger pattern 109 is not even recognizable. This is especially so if the glue 83 is fairly colorless.

FIG. 4 illustrates that just above and below the slat 91, a layer of glue or contact adhesive can be applied, and seen as layer 115 and 117. This layer may be and is preferably extremely thin and may be applied by spray or the like, even in a pattern which may give less than full statistical coverage of the surfaces 93 and 95. A layer of pattern paper 121 is seen to sandwich the glue layer 115 between pattern paper 121 and surface 93 of the slat 91. The term "paper" is used to indicate a paper-like dimension, but the actual material of choice may be paper, plastic, sheeting, or any other dimension or area of material whose primary purpose is the application of a pattern onto the slat 91. Other examples may include peel and stick applique, or even sequential painting where the pattern is laid down similar to silk screened t-shirt manufacture, sequentially with each portion of the pattern being added at different times. Thus the term "paper" is not limited to paper cellulose products. Selection is made such that the glue layers 115 and 117 do not react with, especially from a color change standpoint, the layers 121 and 123.

Similarly, a layer of pattern paper 123 is seen to sandwich the glue layer 117 between pattern paper 123 and surface 95 of the slat 91. The pattern paper may be available, for example, in rolls 125 and may be applied by machine. Where many slats 91 are to be produced at one time, a device is easily formed which may apply the glue layers 115 and 117 by rolling, spraying and the like, followed by rolled application of pattern paper 121 and 123 from matching rolls 125. In this manner, the appropriate amount of glue and the appropriate amount of pressure may be applied to the pattern paper 121 and 123 as it is applied to the slat 91.

Pattern paper 121 has an upper surface 127 facing away from the slat 91 containing a pattern. The pattern may be a wood grain, a solid color, a decorative pattern or any other design which can be expressed on paper or any layered surface, even by painting, for but one example.

Where paper or other unfinished material is used as the layers 121 and 123, subsequent glazing to a slick washable surface finish is desirable. The order of subsequent steps, and in particular any glazing step will depend in large part the materials chosen for the layers 121 and 123 and in use with some of the other processing steps.

As indicated before, it is preferable for the wood tones to be even, and especially where the color, patterns or thickness of the layers 121 and 123 are such as to transmit light and dark patterns which may occur on the surfaces 93 and 95 through the layers 121 and 123. However, where this does occur, and where patchy or splotchy wood discoloration may show through, an optional glue layer 131 along with an optional covering layer 133, perhaps white, is seen to one side of and fittable underneath the layer 115 and atop the surface 93. Interposition of these wood color evening layers 131 and 133 should be accomplished with due consideration of the color and pattern on the layers 121 and 123. In some cases, extreme discoloration of the wood may be covered by relatively thicker layers 121 and 123. Materials and wood quality will control whether or not layers 121 and 123 are even needed.

Referring to FIG. 5, an operation is shown as occurring to a fully formed slat 91, and which may have been formed of two to many individual lengths of board 55, 57, etc. Prior to the processing seen in FIG. 5, the slat 91 will simply consist of a piece of wood having an upper layer 121 and a lower layer 123 glued onto it. The side edges of the paper, as they meet the first and second side surfaces 97 and 99, are closely adhered to the surface of slat 91 at their edge of termination. Some glue may fill the gap and prevent micrometer upward protrusion of the paper. To the extent that the glue fails to completely even up the surface 127 with the adjacent bare wood, one of either or both of glazing or side painting will effectively complete this evening.

Considering side painting, the right half of FIG. 5 illustrates paint applicators 135 applying a spray of paint 137 to the first side surface 97, and not shown, but also to the second side surface 99. Paint may be applied to individual slats 91, or it may be applied to a stack of slats 91. Where stacking, shown at the right side end of FIG. 5, is accomplished, the sandwiching pressure on the slats 91 can prevent sprayed paint from entering spaced between the surfaces 127. Other methods for applying the paint 137 may be by rolling, brushing, and the like. The color of paint 137 selected should blend as much as possible with the color or pattern on the surface 127. Because the first and second side surfaces are of such limited surface area, the effect of a solid color of paint, compared to a wood grain pattern on the pattern paper 121 and 123 will be minimum. The effect of the solid side colors will be non-noticeable or give the impression that the sides of natural wood were simply painted a solid color. Where paint is used as the paper 121 and 123, the pattern may be combined with side painting to create a completely four dimensional pattern. Thus where application of the paper 121 and 123 layers is omitted, the painting step of FIG. 5 can be used to simply create a finished slat 91 with paint, sometimes in one step. Further, as micro paint control is known, such paint could be accomplished with a color bar, where the slat simply passes through an area which "draws" the desired pattern onto the slat 91. Other combinations are possible.

At the other end of FIG. 5, a set of nozzles 141 are shown applying a glaze material 143 to the upper surface 127 of the pattern paper 121 covered slat 91. Where the glaze is to be applied to both the upper surface 127 and painted first and second sides 97 and 99, the glazing may occur after the painting of the painted first and second sides 97 and 99. Conversely, some glaze material may create better adherence of the paint for the painted first and second sides 97 and 99, and thus, especially where the paint is high gloss, the glazing may occur first. Typically the glaze may preferably be a semi-gloss as to avoid high mirror type reflectivity when the slats are in a general parallel position within a blind set. The glaze material 143 should facilitate wiped cleaning of the surface of the slat 91 and should exhibit good wear characteristics under conditions of repeated cleanings over its lifetime.

Referring to FIG. 6, a perspective illustration of a slat undergoing further processing is seen. On the right hand side, a punching device 151 forces a punch ram 153 through the slat 91 to expel a wafer 155. Also, a buffing pad 157 on a shaft 159 provides a smoothing effect and removes any small glaze or paint buildups and gives the resulting finished slat 91 a high quality finish. On the left side of FIG. 6, the finished slat 91 includes an optional slot 161 to accommodate the through-slat suspension string if there is one. In some cases slats can be fixed and angularly operated without the need for openings such as slot 161, and in such cases other hardware or appurtenances may be attached to the slat 91. At the left side of FIG. 161, upper surface 127 shows a wood grain pattern which was previously painted upon pattern paper 121 and 123. Again, any pattern is possible, and the wood grain is but one example.

The shape of slat shown herein has thus far been a rectangular shape and such illustrations have been rectangular to simplify an explanation of the method involved. However, other shapes are possible, especially due to new cutting techniques as well as the ability of band saws to be guided to form different cutting shapes. Referring to FIG. 7, an end view of an oval shaped slat 171 is shown and may be formed by independent processing or by starting with a board 55 having patterns, for example on surfaces 35 and 37, for example.

Referring to FIG. 8, an end view of a slat 175 having double curvature is seen, and may be formed by a curved saw blade, for example. Similarly, referring to FIG. 9, an end view of a slat 177 is seen as having an uneven curvature and rounded edges. Any combination of slat shapes are possible, either through advanced cutting or through further processing, cutting bending and shaping after an individual slat 91, 171, 175, or 177 or other has been formed.

The description previously has been deliberately simplified to illustrate the formation of the interlocking sets of wood protrusions 63 and wood depressions 65 which form the finger pattern 109. One simplification was in beginning the process with a single, solid, although abbreviated length of board. The starting material need not have been a solid piece of material.

Figure 10:
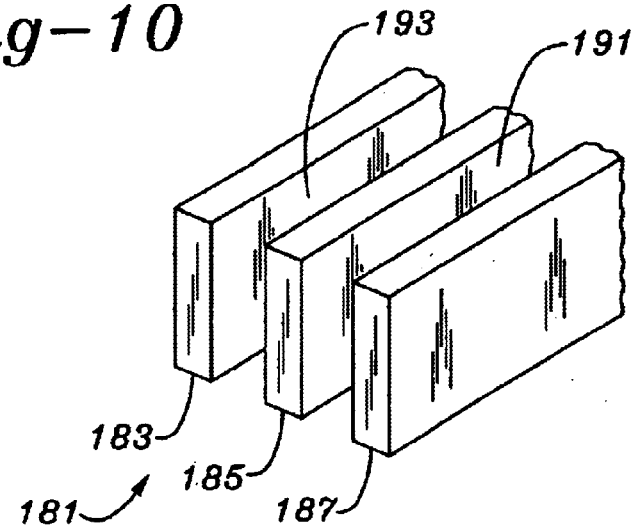

FIG. 10 illustrates a perspective view of a grouping 181 of three boards 183, 185 and 187 shown having glue 83 applied there between, and movement together being joined together as by gluing and the like, into a single block of material. Now ideally, the interface boundaries shown as 191 and 193, which start out as being the areas between the boards 183, 185 and 187, and which will be narrow and filled with glue, will not extend across the final slat 91 laterally with respect to the major axis of its length so as to weaken it. Other orientations, such as would place an interface boundary in a general parallel relationship to a finished slats first and second surfaces 93 and 95, taken with respect to FIG. 3, are not favored unless it can be assured that the glue 83 will be strong enough not to delaminate or weak enough that its parallel position would impair further processing, such as buffing, sanding, and the like. Where such a super strong glue is available, an interface boundary 191 and 193 may be allowed to approach a parallel orientation with first and second surfaces 93 and 95. Further, orientations for the interface boundaries 191 and 193 shown in FIG. 10 may also differ from their generally vertical and parallel relationship to a slanted and non-parallel relationship, and even a horizontal relationship, if such a glue 83 with good strong properties were to be used. However, assuming that such a glue is not available, the generally vertically oriented interface boundaries 191 and 193 will give the strongest relationship against the most severely expected stresses and strains which slat 91 is expected to encounter.

Figure 11:
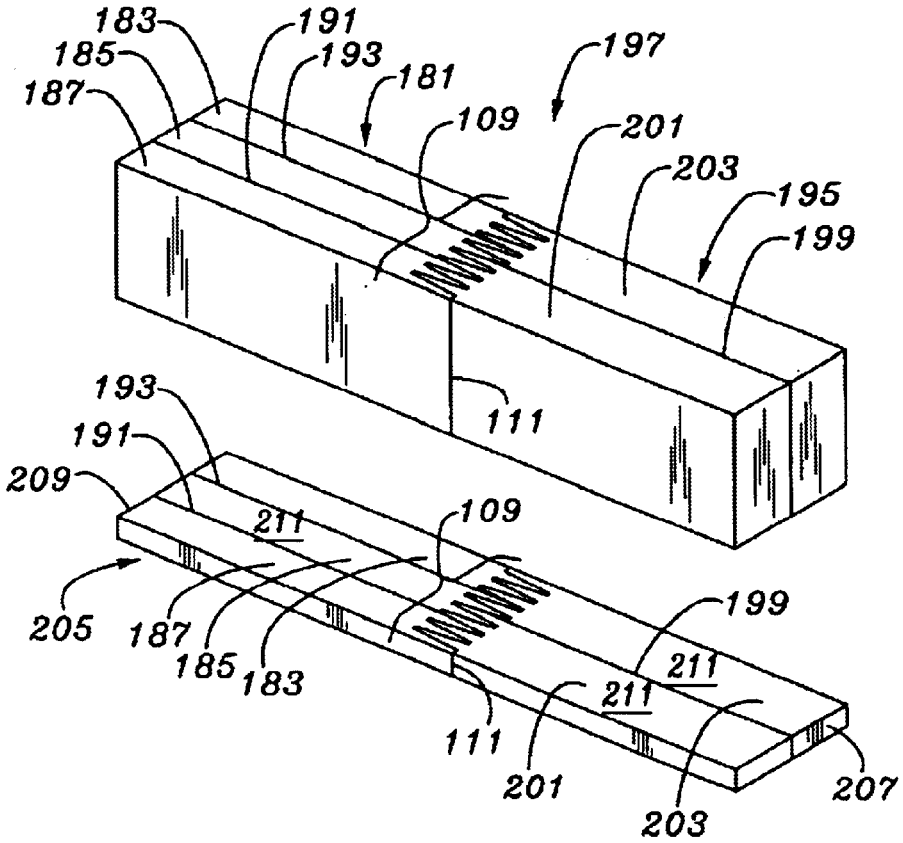
FIG. 11 illustrates the utilization of the three board set with the finger pattern formed as seen in FIGS. 1–9 in conjunction with a two-board set, and along with subsequent slat formation by cutting.

FIG. 11 illustrates the utilization of the three board set 181 with the finger pattern 109 formed as seen in FIGS. 1–9, to form a finger pattern 109 due to the interlocking protrusions 63 and depressions 65, to form, in conjunction with a two-board set 195, an integrated board 197. Integrated board 197 is one of many, and is used to illustrate that it may be preferable that the board sets, 181 and 195 for example, not have interface boundaries 191 and 193 which would align with an interface boundary 197 seen between boards 201 and 203 of board set 195. A slat 205 is shown as produced by cutting the bottom of the integrated board 197 to produce a slat 205 having the finger pattern 109 and separation 111, as well as shallow interface boundaries 191, 193, and 199. The major stress on the slat 205 is likely to be against the middle, roughly the position where the finger pattern 109 is seen and against ends 207 and 209. As such, any interface boundaries 191, 193, and 199 will neither detract from nor add to the strength against this sort of bending. For a given strength of glue 83, orientations of the interface boundaries 191, 193, and 199 which deviate from being vertically perpendicular to an upper surface of the slat 205 may tend toward weakening slat 205 with respect to the aforementioned stress orientation. Again, this is not to say that other orientations for the interface boundaries 191, 193, and 199 are not possible, and may depend upon the combination of glue 83 and wood materials used. Again, a single elongate slat may have several finger patterns 109 and may have sections made from one, two, three or more boards 183, and which may extend through sections having one lateral section 211, to two, to three, and then back to two. It is desired that the thicknesses of the boards 183, 185 and 187 be such that the interface boundaries 191, 193, and 199 not come into alignment at the area of finger patterns 109, so that the finger pattern area 109 may be an area of further urging together of the different board areas.

Figure 12:
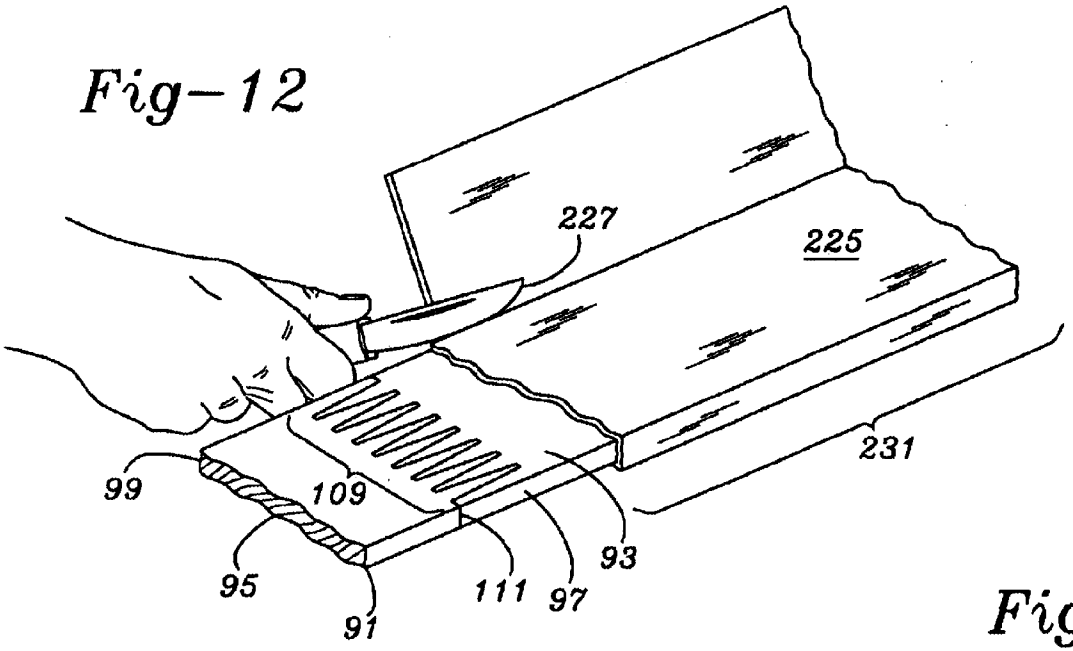
FIG. 12 illustrates a four sided wrapped version of the slat with wrapping occurring about the top, right side, bottom and left side, with a precision knife shown trimming the wrapping to evenness.

Referring to FIG. 12, a slat 91, as before, has a first surface 93, second surface 95, first side surface 97 and second side surface 99. Also as before, finger pattern 109 occurs periodically along the slat 91's length. In this instance, the slat 91 will have all four sides wrapped with a length of full width applied covering 225 which may be made of pattern paper. The pattern paper has a width which is at least as wide as the width of the first surface 93, second surface 95, first side surface 97 and second side surface 99 combined. Where the finishing is to be a cutting operation, the width will ideally be wide enough to support any cutting operations of a machine or manual cutting which facilitates a good finish. For example, even by hand, it may be preferable to pull any excess width of pattern paper taught in order to avoid cutting blade drift. Where cutting is done by machine, the machine may be able to continuously grasp the excess width and apply taught pressure in order to produce a cleaner cut. In FIG. 12, a blade 227, which is a schematically shown blade, is seen proceeding along the length of the slat 91 along a fully wrapped section 231. The blade 227 is shown at an angle which is about forty five degrees with respect to first surface 93 and second side surface 99. This technique, using the added upper dimension of the starting edge of the applied covering 225 to set the level of cut, will insure that the remaining, opposing side edges after cutting will be as evenly matched into an enclosing parameter as possible.

Another alternative for the cutting and finishing would be a fine grinding action upon the edge of the overlap which would tend to form a micro-blend of the of the remaining, opposing side edges after grinding.

Another technique is to use a glue which is matched to the color of the applied covering 225 in order to provide a micro-filler between the two remaining, opposing side edges after cutting. With this technique, a micro-gap would be deliberately created, but in which the filler glue could be pressed to the surface to provide a closest possible joinder of the of the remaining, opposing side edges after grinding. It would in effect be a pattern matching space.

All three techniques and more can be combined with carefully calculated pattern matching, such as a print pattern, where the visual match across the gap of the remaining opposing side edges after cutting is so powerful that it dominates any such small gap remaining. Still other techniques may be combined including further roller pressing of the applied covering 225. Where a small gap is created, and it is known that for certain types of glue at certain temperatures and conditions that further pressing of the fully wrapped section 231 will cause the of the remaining, opposing side edges to move toward each other a predetermined amount, such pressing technique can be used to close the small gap to a sharp right angle. Other techniques for cutting the applied covering 225 can be employed.

The manner of supplying the applied covering 225 and its manner of application to the slat 91 can also be widely varied. Where the applied covering 225 is supplied in roll form as was shown in FIG. 4, although in a single roll rather than two rolls and in a much wider format, it can be applied to the slat in a batch type process or a continuous type process.

In a continuous type process, the applied covering 225 is applied linearly utilizing a wrapping guide which adjusts the angle of wrap and application about each of the surfaces as both the applied covering 225 and the slat 91 move linearly in the same direction. A guide can be used to sequentially apply the applied covering 225 to the slat 91 as they both proceed forward. The sequential application is used to smooth and press one surface just before the next adjacent surface meets the applied covering 225. With this process, application and pressing can be carefully controlled. Glue can be applied as by spraying as seen in FIG. 5, for example, or by rollers or the like. Where the applied covering 225 is applied as a roll, provision can be made to cut between adjacent slats 91 and the like.

Figure 13:
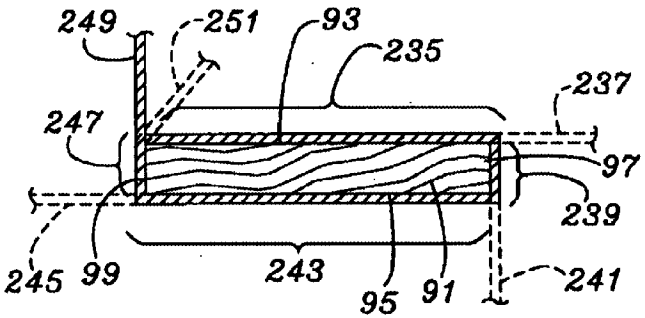
FIG. 13 illustrates a sectional end view of the slat being sequentially wrapped which may occur at the same distance along the length of the slat or over different lengths.

In the alternative, the applied covering 225 may be applied by a batch process, where the applied covering 225 is applied in one individual step to a given length of slat 91 in a "wrapping" sequence. In FIG. 13, an end sectional view illustrates this wrapping, but also illustrates the above guide sequential application of the applied covering 225. In FIG. 13, the dashed line format is used to indicate the portion of the applied covering 225 which is away from the slat 91 as another portion is applied.

For example, in a first step, for example, a width 235 of applied covering 225 is applied to a first (upper with respect to FIG. 13) surface 93 with a not yet applied width 237 shown in dashed line format. In the next step, the not yet applied width 237 is folded down to apply a width 239 of applied covering 225 to cover a first side surface 97 with a not yet applied width 241 shown in dashed line format. In the next step, the not yet applied width 241 is folded across to apply a width 243 of applied covering 225 to cover a second surface 95 with a not yet applied width 245 shown in dashed line format. Finally, In the last application step, the not yet applied width 245 is folded (up with respect to the orientation of FIG. 13) to apply a width 247 of applied covering 225 to cover a second side surface 99 with an optional excess width 249 shown in dashed line format awaiting further treatment to cut or remove it from the now four sided covered slat 91. A tangential line of cut or removal is seen as a dashed line 251, and typically occurs at the point where any excess width of applied covering 225 is to be cut away.

Figure 14:
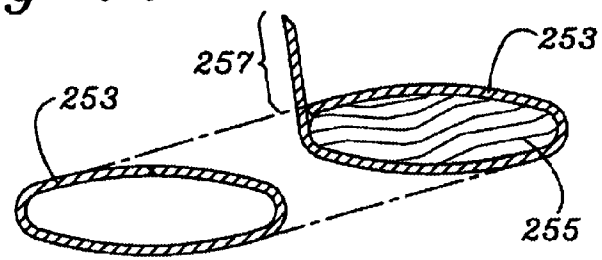
FIG. 14 illustrates an end view of a slat having an oval cross section.

Referring to FIG. 14, an illustration that other shapes of slat 91 can be covered in the same way as was the case for slat 91. An oval slat 255 has a continuous coating of applied covering 253 and illustrates an option extension of the excess in dashed line format as excess 257 as the width of the applied covering 225, such as pattern paper, extending beyond the point at which the first side edge of the pattern paper was first applied. Glue 143, as in FIG. 5, can be applied to assist attachment of any applied covering. Again, the excess 257 is not necessary depending upon the type of application desired, but is illustrated to show how the technique could occur. Without the optional excess 257 applied covering 253 can also be a continuous hollow annular cylinder.

Another technique illustratable with respect to all of the Figures, and especially FIGS. 13 and 14 would be the provision of an applied covering 253 as a single piece of annularly cylindrical shrink wrap. In this method, the slat, such as oval slat 255 is inserted into a prepared hollow annularly cylindrical sleeve 253 (applied covering) and then treated to have the sleeve 253 shrink to fit tightly about the slat 255. One method is by heat shrinking. This type of production is more batch processed in that each slat 255 section must be inserted before the sleeve 253 can be shrunk. A separated sleeve 253 is shown adjacent the oval slat 255.

Summarizing the production steps, first the materials are selected and prepared, including removal of debris, providing, where possible, a completely flat set of outside surfaces to the extent possible where necessary to prevent further surfacing/cutting steps further along in the process. The raw lengths of material can then be further selected, segregated and collected for common characteristics, including matching tone, color, grain, and the like, especially where common characteristics will add to the final finish and prevent unwanted discontinuities. For example, where a light or thin, or light and thin applied covering 253 or 225 will be used, extreme differences in the color of the underlying wood material may show through. An alternative to such segregation would be application of additional layers of applied covering, which is likely not achievable by simply piling on as it would affect other characteristics of the finished slat 91, 171, 205, or 255.

Next, the boards 183, 185, 187 which are of thinner dimension, such that they would form slats 91, 171, 205, or 255 in which two or more lengths of material may be joined by gluing and the like in parallel leading up to a finger pattern 109 in the finished slat 91, 171, 205, or 255. Preferably the meeting surfaces of the laterally joined boards 183, 185, 187 will be of close tolerance to enable the correct amount of glue to be distributed for maximum hold.

After laterally joined boards 183, 185, & 187 (and more or less as necessary to form two, three, four, five or more thinner strips in a slat 91, 171, 205, or 255) have been glued together, and to the extent necessary, further cutting may be performed. Such further cutting may be preferably to set the size of the resulting slats 91, 171, 205, or 255 to avoid further cutting at the slat's outer edge, or such further cutting may include finishing of some ends which will form the slat 91, 171, 205, or 255 ends 207 & 209.

Next, certain ends of the laterally joined boards 183, 185, & 187 (or the boards 21) are selected for forming the protrusions 45 and radial depressions 47 for the board sections from either the glued grouping of from two to eight or nine laterally joined boards 183, 185, & 187, such as board set 181 or 195, etc., or by using board 21. After the board sections are joined and glued, and after the glue has set, the composite, elongate, joined board undergoes cutting in a slicing fashion to form the slat 91, 171, 205, or 255.

Once the slat 91, 171, 205, or 255 is formed, other operations may include inspection and sanding where necessary, especially depending upon the exactness employed in the slicing operation. Next, the one of the applied coverings 253 or 225 is added. Applied covering 225, if a sheet material is typically wrapped a full 360° around the slat 91, 171, 205, or 255, especially where the applied covering 225 is a wood pattern. Complete 360° covering can be set to produce a slat 91, 171, 205, or 255 having an appearance as if it were formed of a single length of natural material. The finger pattern 109 typically cannot be seen through the applied covering 225, even where applied covering is a laminated paper label. As such, the slat 91, 171, 205, or 255 is treated as if it were formed of a single length of material, with no concern needing to be given to the location or number of the finger patterns 109 which may occur along the length of a given slat 91, 171, 205, or 255. The applied covering 225 may be a thin paper having a light weight is typically applied with a vinyl acetate resin glue. The applied covering 225, after it is in place on the slat 91, 171, 205, or 255, is further covered with an applied lacquer, such as may be available commercially from Akzo Nobel Company, especially a 4.5% white mixture sold under the product identification number 890-WSG020. A surface lacquer coat of ultraviolet resistant material may be applied at a rate of six grams per square meter over two applications. A side application may be had for non clear lacquer as where only the top and bottom of the slat 91, 171, 205, or 255 is to be covered. The surface and painting steps may preferably be accomplished by two applications at about six grams per square meter over a time period of about fifteen seconds. The ultra violet light resistant coatings, or UV coatings, give the resulting slat a long window life and improved color consistency.

Figure 15:
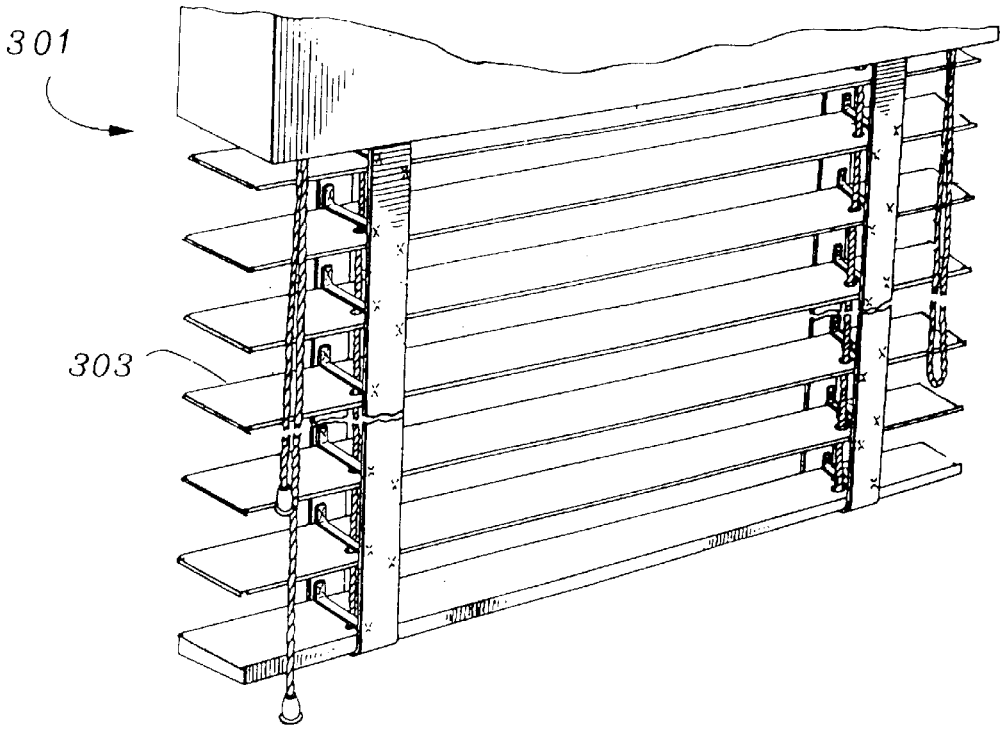
FIG. 15 is a perspective view of a window covering device.

Referring to FIG. 15, a perspective view of a window covering device 301 having a series of slats 303, made in a manner in accord with the aforementioned methods, is shown.

While the present invention has been described in terms of a system and method for forming slats from lengths and collective widths of various shapes of relatively shorter, relatively less narrow pieces of material and for shifting the economics of slat making towards a more efficient use of scrap and for freeing longer lengths of wood stocks for other uses, one skilled in the art will realize that the structure and techniques of the present invention can be applied to many structures, including any structure or technique where joinder with enhanced contact structures and where joinder with interlocking finger structures can be utilized, where lateral joinder of different materials may be enhanced and where structures like finger grooves or protrusions and depressions can be advantageously used to interrupt differences in natural wood extents.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A slat for a window covering comprising:

a first structure having a first surface opposing a second surface, a first end extending between said first and second surfaces opposite a second end extending between said first and second surfaces, a first side surface extending between said first and second surfaces and between said first and second ends, and a second side surface, oppositely disposed with respect to said first side surface, extending between said first and second surfaces and between said first and second ends, said first end having a first alternating series of protrusions and depressions;

a fourth structure having a third surface opposing a fourth surface, a third end extending between said third and fourth surfaces opposite a fourth end extending between said third and fourth surfaces, a third side surface extending between said third and fourth surfaces and between said third and fourth ends, and a fourth side surface, oppositely disposed with respect to said third side surface, extending between said third and fourth surfaces and between said third and fourth ends, said third end having a second alternating series of protrusions and depressions, said first alternating series of protrusions and depressions complementary to and interfitted and attached with said second alternating series of protrusions and depressions, and wherein said first and said second set of alternating series of protrusions and depressions has an ideal ratio of a height of said protrusion and depression to a width of said protrusion and depression of about 2.75:1 to about 3.25:1.

2. A slat for a window covering comprising:

a first structure having a first surface opposing a second surface, a first end extending between said first and second surfaces opposite a second end extending between said first and second surfaces, a first side surface extending between said first and second surfaces and between said first and second ends, and a second side surface, oppositely disposed with respect to said first side surface, extending between said first and second surfaces and between said first and second ends, said first end having a first alternating series of protrusions and depressions;

a fourth structure having a third surface opposing a fourth surface, a third end extending between said third and fourth surfaces opposite a fourth end extending between said third and fourth surfaces, a third side surface extending between said third and fourth surfaces and between said third and fourth ends, and a fourth side surface, oppositely disposed with respect to said third side surface, extending between said third and fourth surfaces and between said third and fourth ends, said third end having a second alternating series of protrusions and depressions, said first alternating series of protrusions and depressions complementary to and interfitted and attached with said second alternating series of protrusions and depressions, and wherein said first and said second set of alternating series of protrusions and depressions have a contact surface area ratio of at least about 6.33:1.0 with respect to a flat contact surface area of said first and said third end were such protrusions and depressions not present.

3. The slat as recited in claim 1 and further comprising a layer of decorative material applied to at least one of said first and said second surfaces.

4. The slat as recited in claim 3 wherein said decorative material is an applied liquid.

5. The slat as recited in claim 3 wherein said decorative material is a thin layer of material applied to at least one of said first, second, third and fourth surfaces of said slat.

6. The slat as recited in claim 1 wherein at least one of said first and said second surfaces of said slat are cut surfaces formed by cutting said slat away from at least one board of material.

7. The slat as recited in claim 1, each of said first and said second structures having a plurality of protrusions and a plurality of depressions and wherein at least one of said protrusions of each of said first and said second structures adjacent at least one of said first, second, third and fourth side surfaces is slightly wider than the other of said protrusions of associated one of said first and second structures, ignoring and excluded from said ideal ratio of a height of said protrusion and depression to a width of said protrusion and depression.

8. The slat as recited in claim 3 and further comprising a layer of covering material interposed between said layer of decorative material and said at least one of said first and said second surfaces in order to mask any blemishes which might show through said layer of decorative material.

9. The slat as recited in claim 3 and further comprising a layer of glaze covering said layer of decorative material to effect a surface finish for said slat.

10. The slat as recited in claim 1 wherein said first structure further comprises at least two structures joined together and having at least a first interface boundary extending to at least one of said first and said second surfaces.

11. The slat as recited in claim 10 wherein said second structure further comprises at least two structures joined together and having at least a second interface boundary extending to at least one of said third and said fourth surfaces and wherein said at least a first interface boundary is not collinear with said at least a second interface boundary.

12. A process for constructing a slat comprising:

in a first board having a first surface opposing a second surface, a first end extending between said first and second surfaces opposite a second end extending between said first and second surfaces, a first side surface extending between said first and second surfaces and between said first and second ends, and a second side surface, oppositely disposed with respect to said first side surface, extending between said first and second surfaces and between said first and second ends, forming at said first end a first alternating series of protrusions and depressions;

in a second board having a third surface opposing a fourth surface, a third end extending between said third and fourth surfaces opposite a fourth end extending between said third and fourth surfaces, a third side surface extending between said third and fourth surfaces and between said third and fourth ends, and a fourth side surface, oppositely disposed with respect to said third side surface, extending between said third and fourth surfaces and between said third and fourth ends, forming at said third end a second alternating series of protrusions and depressions complementary to said first alternating series of protrusions and depressions, and wherein said first and said second set of alternating series of protrusions and depressions has an ideal ratio of a height of said protrusion and depression to a width of said protrusion and depression of about 2.75:1 to about 3.25:1;

affixing said third end of said second board and said first end of said first board together with said first and said second alternating series of protrusions and depressions interfitting with one another to form a joined board; and cutting said joined board parallel to at least one of said first and second surfaces to form a slat having at least one of said first and said second surfaces.

13. The process of forming a slat as recited in claim 12 wherein each protrusion of said first alternating series of protrusions and depressions extends from immediately adjacent said first surface to immediately adjacent said second surface, and wherein each protrusion of said second alternating series of protrusions and depressions extends from immediately adjacent said third surface to immediately adjacent said fourth surface.

14. The process of forming a slat as recited in claim 12 wherein each depression of said first alternating series of protrusions and depressions extends from immediately adjacent said first surface to immediately adjacent said second surface, and wherein each depression of said second alternating series of protrusions and depressions extends from immediately adjacent said third surface to immediately adjacent said fourth surface.

15. The process of forming a slat as recited in claim 12 and further comprising the step of applying a layer of decorative material to at least one of said first and said second surfaces.

16. The process of forming a slat as recited in claim 15 and further comprising the step of applying a layer of glaze to said decorative material.

17. The process of forming a slat as recited in claim 12 and further comprising the step of applying a layer of paint to at least one of said first, second, third, and fourth side surfaces.

18. The slat as recited in claim 1 wherein said first structure further comprises at least two structures joined together and having at least a first interface boundary extending to at least one of said first and said second side surfaces.

19. The slat as recited in claim 10 wherein said first interface boundary is a glued interface boundary.

20. The slat as recited in claim 9 wherein said glaze covering is an ultraviolet resistant lacquer.

* * * * *